US008550153B2

(12) United States Patent
Yin et al.

(10) Patent No.: US 8,550,153 B2
(45) Date of Patent: Oct. 8, 2013

(54) HEAT EXCHANGER AND METHOD OF OPERATING THE SAME

(75) Inventors: Jian-min Yin, Racine, WI (US); Gregory G. Hughes, Milwaukee, WI (US)

(73) Assignee: Modine Manufacturing Company, Racine, WI (US)

( * ) Notice: Subject to any disclaimer, the term of this patent is extended or adjusted under 35 U.S.C. 154(b) by 873 days.

(21) Appl. No.: 12/572,310

(22) Filed: Oct. 2, 2009

(65) Prior Publication Data

US 2010/0084120 A1 Apr. 8, 2010

Related U.S. Application Data

(60) Provisional application No. 61/102,458, filed on Oct. 3, 2008.

(51) Int. Cl.
*F28F 13/00* (2006.01)
*F28D 1/02* (2006.01)
*F28D 7/02* (2006.01)

(52) U.S. Cl.
USPC ..... 165/146; 165/165; 165/166; 165/153

(58) Field of Classification Search
USPC ..... 165/151, 152, 166, 167, 174, 153, 165/146, 147
See application file for complete search history.

(56) References Cited

U.S. PATENT DOCUMENTS

| | | | | |
|---|---|---|---|---|
| 2,566,310 | A * | 9/1951 | Burns et al. | 165/140 |
| 2,900,175 | A | 8/1959 | McGuffey et al. | |
| 3,161,234 | A * | 12/1964 | Rannenberg | 165/163 |
| 3,334,399 | A * | 8/1967 | Teeguarden | 29/890.039 |
| 3,380,517 | A * | 4/1968 | Butt | 165/166 |
| 3,461,956 | A * | 8/1969 | Otto | 165/166 |
| 3,731,736 | A * | 5/1973 | Fernandes | 165/166 |
| 4,282,927 | A * | 8/1981 | Simmons | 165/166 |
| 4,623,019 | A | 11/1986 | Wiard | |
| 4,731,072 | A * | 3/1988 | Aid | 604/408 |
| 5,062,477 | A | 11/1991 | Kadle | |

(Continued)

FOREIGN PATENT DOCUMENTS

| | | |
|---|---|---|
| DE | 3302150 | 7/1984 |
| DE | 60207766 | 6/2006 |
| DE | 602005004102 | 4/2008 |
| JP | 61186794 | 11/1986 |

OTHER PUBLICATIONS

German Search Report from Patent Application No. 10 2009 048 060.9, dated Sep. 9, 2010, 4 pages.

*Primary Examiner* — Allen Flanigan
*Assistant Examiner* — Jason Thompson
(74) *Attorney, Agent, or Firm* — Michael Best & Friedrich LLP

(57) ABSTRACT

An evaporative heat exchanger including a plurality of parallel flow passages extending through the heat exchanger and together defining a first fluid flow path, and a plurality of substantially parallel stacked plates interleaved with the parallel flow passages. Each plate can have first, second, and third sets of flow channels, a first collection manifold adjacent to an end of the plate and connecting the first and second passes, and a second collection manifold. The second collection manifold can intersect the second set of flow channels and at least some of the third set of flow channels. The plate separates the first set of flow channels from the second collection manifold.

20 Claims, 8 Drawing Sheets

(56) References Cited

U.S. PATENT DOCUMENTS

| | | | | |
|---|---|---|---|---|
| 5,318,114 | A | 6/1994 | Sasaki | |
| 5,517,757 | A * | 5/1996 | Hayashi et al. | 29/890.039 |
| 6,039,112 | A | 3/2000 | Ruppel et al. | |
| 6,301,109 | B1 * | 10/2001 | Chu et al. | 361/690 |
| 6,948,559 | B2 * | 9/2005 | Reinke et al. | 165/140 |
| 7,121,331 | B2 | 10/2006 | Yoshida et al. | |
| 7,182,125 | B2 * | 2/2007 | Martin et al. | 165/109.1 |
| 2006/0191674 | A1 * | 8/2006 | Persson | 165/167 |
| 2007/0017661 | A1 * | 1/2007 | Geskes et al. | 165/166 |
| 2007/0221366 | A1 * | 9/2007 | Murayama et al. | 165/166 |
| 2007/0261815 | A1 * | 11/2007 | Melby et al. | 165/41 |

* cited by examiner

HEAT EXCHANGER AND METHOD OF OPERATING THE SAME

CROSS-REFERENCE TO RELATED APPLICATIONS

The present application claims priority to U.S. Provisional Patent Application Ser. No. 61/102,458, filed Oct. 3, 2008, the entire contents of which is hereby incorporated by reference.

FIELD OF THE INVENTION

The present invention relates to heat exchangers, and more particularly to evaporative heat exchangers having a number of stacked plates at least partially defining two separate and substantially adjacent fluid flow paths

SUMMARY OF THE INVENTION

Attempts to use stacked plate style heat exchangers in applications where one of the fluids experiences a change of phase from a liquid to a vapor have been problematic. In such applications the fluid that is evaporating exists, over at least a portion of its flow path through the heat exchanger, as a two-phase fluid having both vapor and liquid fractions. The vapor fraction tends to separate from the liquid fraction due to the substantial differences in densities between the phases, making it difficult to achieve a uniform distribution of the fluid over the multiple parallel passages. This maldistribution effect can be especially pronounced when the flow path through the heat exchanger is circuitous, requiring the fluid to make multiple changes in flow direction. When the distribution is not uniform, the performance of the heat exchanger tends to suffer. Separation of the phases of the evaporating fluid can result in liquid flooding of certain regions, with slugs of the liquid forced through the heat exchanger at a non-constant rate. For this reason, evaporative heat exchangers have often been of a construction wherein the evaporating fluid does not require redistribution along its flow path.

In certain evaporative heat exchanger applications, it may be especially beneficial to arrange the flow passages so that the hot fluid and the evaporating fluid pass through the heat exchanger in a counter-flow or in a concurrent flow orientation to one another. A counter-flow orientation may be desirable when the hot fluid is to be cooled to as low a temperature as possible, or when the evaporating fluid is to be superheated to as high a temperature as possible. A concurrent flow orientation may be desirable when the hot fluid and the evaporating fluid are to exit the heat exchanger at one common temperature. Examples of such applications include, but are not limited to, air-conditioning and refrigeration chillers, Rankine cycle evaporators, and water and/or fuel vaporizers for fuel processing and fuel cell applications. A disadvantage of using a tube and fin evaporator construction in such applications is the difficulties that it poses in arranging the hot and cold fluid flows in a circuiting arrangement other than cross-flow.

According to one embodiment of the invention, a stacked plate evaporative heat exchanger for the transfer of heat from a first fluid to a second fluid to vaporize the second fluid includes a plurality of separate parallel flow passages to direct the first fluid through the heat exchanger, and a plurality of parallel arranged fluid flow plates for the second fluid interleaved with the parallel flow passages for the first fluid. The fluid flow plates have a first and second set of flow channels extending from a first end of the fluid flow plate to a second end of the fluid flow plate to define a first flow pass for the second fluid. The fluid flow plates further have a third set of flow channels to define a second flow pass for the second fluid parallel to the first pass. A first collection manifold is located at the second end to receive at least a portion of the second fluid flow from the first pass and transfer it to the second pass. A second collection manifold is located between the first and second ends and intersects the second set of flow channels and at least some of the third set of flow channels, but not the first set of flow channels, to receive at least a portion of the second fluid from the first pass and transfer it to the second pass.

In some embodiments, the fluid flow plate is constructed by corrugating a thin sheet of material. The second collection manifold may be defined by slots passing through the corrugations of the fluid flow plate.

In some embodiments, the plurality of separate parallel flow passages are arranged to direct the first fluid through the heat exchanger in a direction approximately perpendicular to the first and second flow passes for the second fluid. In some embodiments the plurality of separate parallel flow passages are arranged to direct the first fluid in two or more sequential passes through the heat exchanger.

In some embodiments, the pressure resistance and heat transfer performance of the heat exchanger may be improved by having a uniformly narrow channel width for the flow channels of the fluid flow plates. In some embodiments the second collection manifold can consist of one or more slots extending through the fluid flow plate. In some embodiments the one or more slots can each have a slot width that is approximately equal to the channel width.

In some embodiments, the fluid flow plates include a fourth set of flow channels to additionally define the second flow pass, and a fifth set of flow channels to define a third pass downstream of the first and second passes A third collection manifold is located at the first end of the fluid flow plate to receive at least a portion of the second fluid from the second pass and transfer it to the third pass. A fourth collection manifold is located between the first and second ends and intersects the fourth set of flow channels and at least some of the fifth set of flow channels, but not the third set of flow channels, to receive at least a portion of the second fluid from the second pass and transfer it to the third pass. In some such embodiments the fluid flow plates include additional flow passes downstream of the third pass.

In some embodiments, the plurality of separate parallel flow passages are at least partially defined by a plurality of stamped plates. Each of the stamped plates can include a recessed area to receive one of the fluid flow plates.

In some embodiments, the present invention provides an evaporative heat exchanger operable to at least partially vaporize fluid. The heat exchanger can include a number of parallel flow passages extending through the heat exchanger, together the flow passages define a first fluid flow path, and a number of substantially parallel stacked plates interleaved with the parallel flow passages. Each plate can have a first end and a second end spaced apart from the first end and at least partially define a first set of flow channels extending from the first end to the second end and a second set of flow channels extending from the first end to the second end parallel to the first set of flow channels. The first and second sets of flow channels together can comprise a first flow pass of a second fluid flow path. Each plate can also include a third set of flow channels extending from the first end to the second end and comprising a second flow pass of the second fluid flow path substantially parallel to the first flow pass of the second fluid flow path, a first collection manifold adjacent to the second end and connecting the first and second passes, and a second collection manifold between the first end and the second end, the second collection manifold intersecting the second set of flow channels and at least some of the third set of flow channels. The can plate separate the first set of flow channels from the second collection manifold.

Other aspects of the invention will become apparent by consideration of the detailed description and accompanying drawings.

DETAILED DESCRIPTION OF THE PREFERRED EMBODIMENT

Before any embodiments of the invention are explained in detail, it is to be understood that the invention is not limited in its application to the details of construction and the arrangement of components set forth in the following description or illustrated in the following drawings. The invention is capable of other embodiments and of being practiced or of being carried out in various ways. Also, it is to be understood that the phraseology and terminology used herein is for the purpose of description and should not be regarded as limiting. The use of "including," "comprising," or "having" and variations thereof herein is meant to encompass the items listed thereafter and equivalents thereof as well as additional items. Unless specified or limited otherwise, the terms "mounted," "connected," "supported," and "coupled" and variations thereof are used broadly and encompass both direct and indirect mountings, connections, supports, and couplings. Further, "connected" and "coupled" are not restricted to physical or mechanical connections or couplings.

Figure 1:
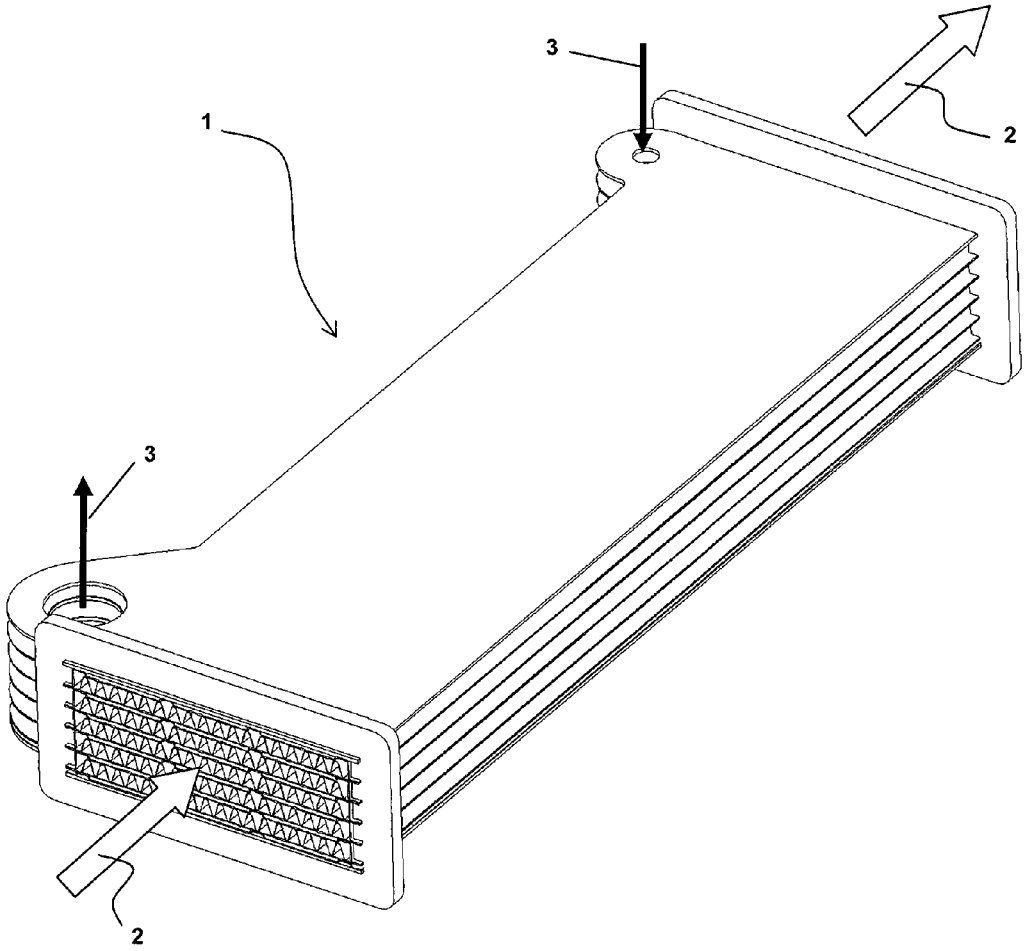
FIG. 1 is an isometric view of a heat exchanger according to some embodiments of the present invention.
Figure 2:
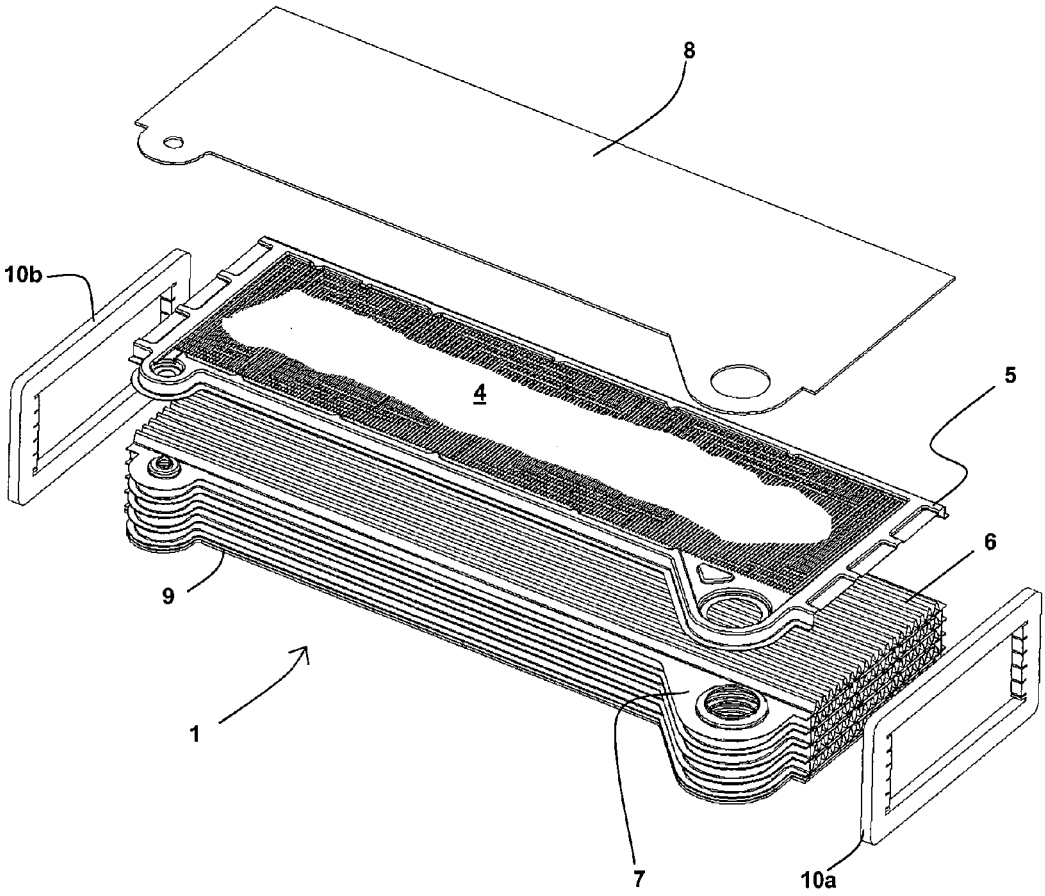
FIG. 2 is a partially exploded isometric view of the heat exchanger of FIG. 1.

FIGS. 1 and 2 illustrate a heat exchanger 1 according to some embodiments of the present invention. The heat exchanger 1 is adapted to receive a first fluid flow 2 and a second fluid flow 3 and to place them in heat exchange relation with one another so as to transfer heat from one of the fluid flows to the other of the fluid flows. The heat exchanger 1 is especially well suited for use when the fluid flow 2 is a hot gas flow and the fluid flow 3 is a liquid or partially liquid flow having a boiling point or bubble point temperature that is lower than the entering temperature of the fluid flow 2, so that heat can be transferred from the first fluid flow 2 to the second fluid flow 3 in order to substantially vaporize the second fluid flow 3.

In some such applications, the heat that is so transferred may be sufficient to fully vaporize the second fluid flow 3, whereas in other applications the heat may be sufficient to vaporize only a portion of the first fluid flow 3. Furthermore, in some applications, the heat that is transferred from the first fluid flow 2 to the second fluid flow 3 may exceed the amount of latent heat required to fully vaporize the second fluid flow 3, so that the second fluid flow 3 exits the heat exchanger 1 as a superheated vapor.

The heat exchanger 1 shown in FIGS. 1 and 2 may be especially useful as an evaporator in a Rankine cycle waste heat recovery system for an internal combustion engine. In such a system, the first fluid flow 2 can be a flow of exhaust gas from the internal combustion engine, and the second fluid flow 3 can be a Rankine cycle working fluid such as water, ammonia, ethanol, methanol, R245fa or similar refrigerants, or a combination thereof. The utility of the heat exchanger 1 is not limited to such applications, however, and no limitations to the use of a heat exchanger according to the present invention are implied unless expressly recited in the claims.

As best seen in FIG. 2, the heat exchanger 1 includes a plurality of parallel arranged stamped shells 5, each of which is adapted to house a fluid flow plate 4 for the second fluid flow 3. The heat exchanger 1 further includes a plurality of convoluted fin structures 6 for the first fluid flow 2 interleaved with the stamped shells 5, and a plurality of stamped shells 7 located between the convoluted fin structures 6 and the fluid flow plates 4 in order to maintain separation between the first and second fluid flows 2 and 3 traveling through the heat exchanger 1. While reference is made herein to stamped shells 5, 7, in some embodiments, the shells 5, 7 can be formed in manners other than stamping. Alternatively or in addition, the shells 5, 7 can be positioned along or form less than the entire first and second fluid flows 2, 3.

In the illustrated embodiment of FIGS. 1 and 2, the stamped plates 5 and 7 are adapted to form sealed edges along the length of the heat exchanger 1. The heat exchanger 1 further includes a top plate 8 and a bottom plate 9, as well as header plates 10 to define an inlet and outlet for the first fluid flow 2. The components of the heat exchanger 1 may be joined to one another by brazing, soldering, welding, or other methods known in the art.

Features of the fluid flow plates 4 and stamped shells 5 will now be further described with reference to FIGS. 3 and 4. The stamped shells 5 include a fluid inlet port 11 to receive the second fluid flow 3 and a fluid outlet port 12 through which the second fluid flow 3 can exit the heat exchanger 1. Between the inlet port 11 and the outlet port 12 the second fluid flow 3 is routed through multiple flow passes defined by the stamped shell 5 and the fluid flow plate 4, with the flow passes extending between parallel ends 40, 41 of the fluid flow plate 4. In the exemplary embodiment shown in FIGS. 3 and 4, a fluid flow would encounter eight passes as it travels from inlet port 11 to outlet port 12. The eight passes are depicted using dashed lines in FIG. 4, with arrows indicating the direction of flow through each pass. It should be recognized that the desirable number of passes would vary with the application, and that heat exchangers having fewer than or more than eight passes are possible.

In the depicted embodiment, the fluid flow plate 4 is a corrugated thin metal sheet. Each of the eight fluid passes 14-21 comprise a plurality of flow channels 13 defined by corrugations of the fluid flow plate 4. The crests of the corrugations may be rounded as shown, or they may be some other shape such as, for example, flat or peaked. During fabrication of the heat exchanger 1, the crests of the corrugations can be bonded to the adjacent surfaces of the stamped plates 5 and 7 in order to define the flow channels 13. Alternatively or in addition, the crest of the corrugations can engage correspondingly shaped recesses or protrusions on the adjacent surfaces of the stamped plates 5 and 7 to seal the flow channels 13.

Adjacent ones of the channels 13 are generally non-communicative with each other, except in the manifold regions to be described later on.

The inlet port 11 is directly connected to the channels 13 comprising the fluid pass 14 at the end 40, so that a portion of the second fluid flow 3 can enter the space between the stamped shell 5 and an adjacent stamped shell 7 or top plate 8 and can flow through the fluid pass 14. After traveling through the pass 14, the fluid can transfer to the pass 15 by way of the collection manifold 22 located at the end 41, and additionally by way of the collection manifold 23 located between the ends 40 and 41. It should be observed that the collection manifold 23 does not intersect some of the channels 13 comprising the pass 14, so that any fluid traveling through these channels is forced to travel the entire length of the channels and through the manifold 20. Additionally, the collection manifold 23 as shown does not intersect some of the channels 13 comprising the pass 15, and any fluid traveling through those channels must come from the collection manifold 22.

After flowing through the pass 15, the fluid can transfer to the pass 16 by way of the collection manifold 24 located at the end 40, and additionally by way of the collection manifold 25 located between the ends 40 and 41. Again, the collection manifold 25 as shown does not intersect some of the channels comprising the pass 15 and does not intersect some of the channels comprising the pass 16.

Figure 3:
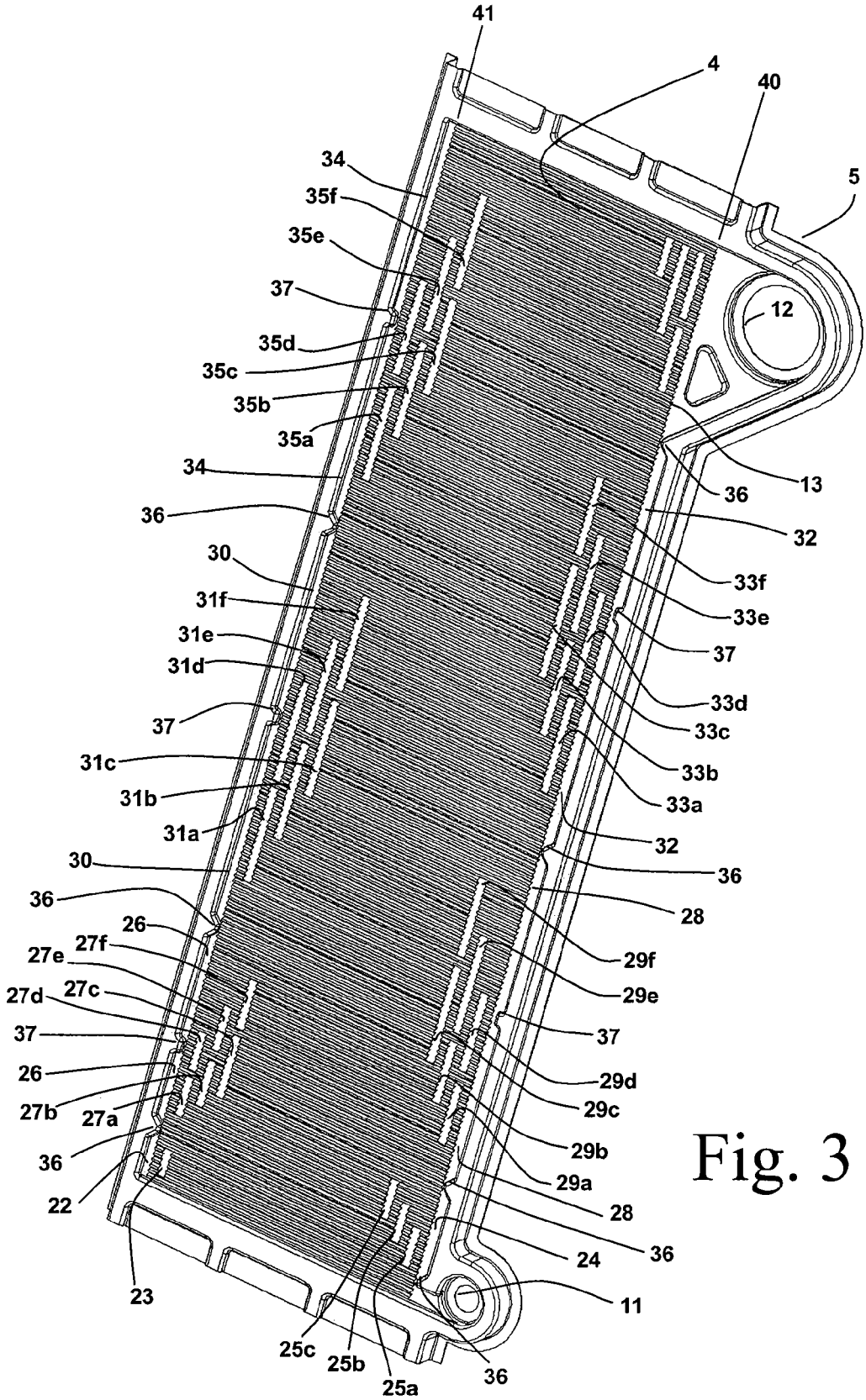
FIG. 3 is an isometric view of certain portions of the heat exchanger of FIGS. 1 and 2.
Figure 4:
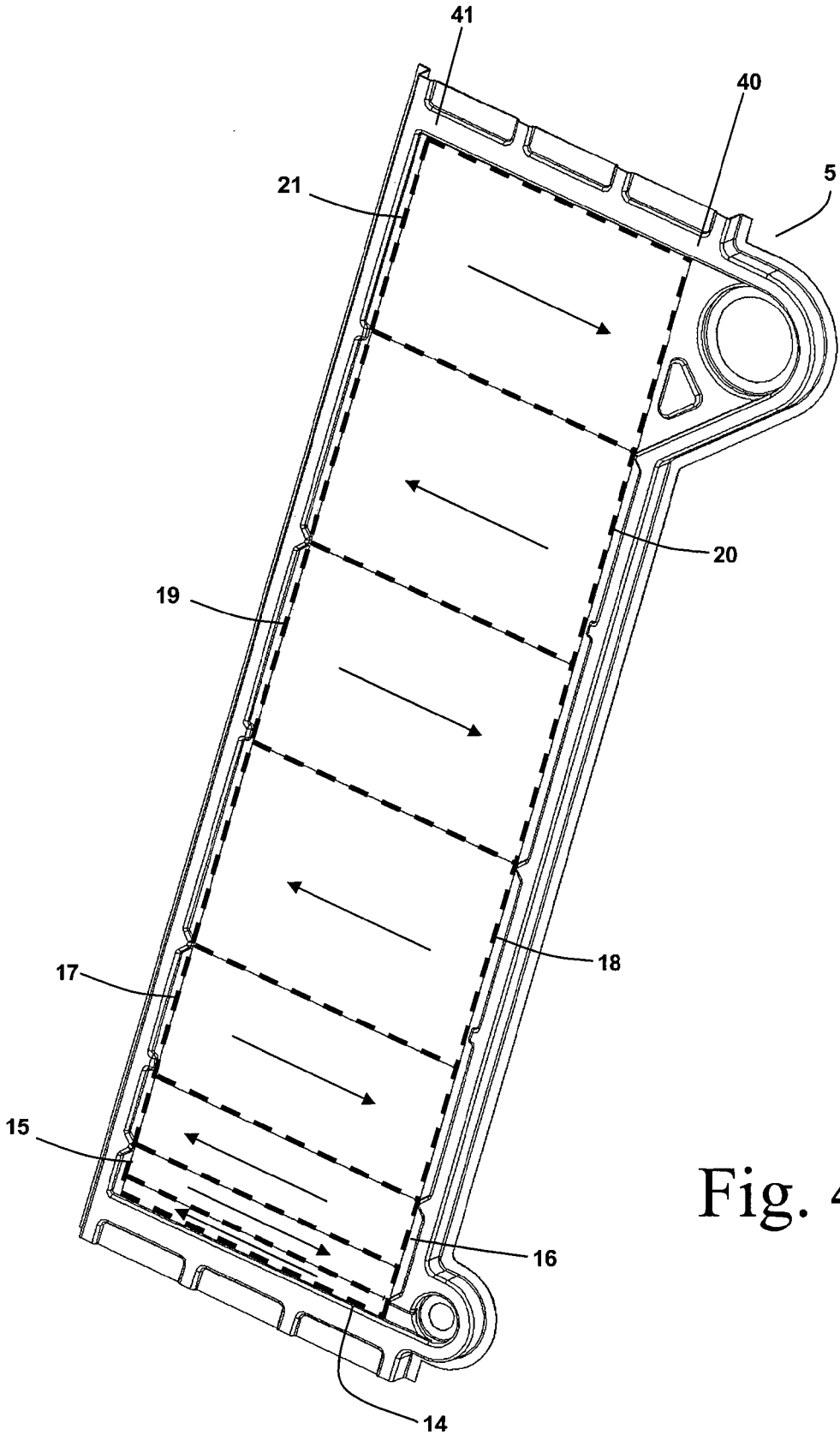
FIG. 4 is similar to FIG. 3 but with certain details removed to more clearly show fluid flow paths.

As can be inferred from inspection of FIGS. 3 and 4, the number of channels comprising any one pass need not be equal to the number of channels comprising any other pass. In fact, it may be preferable in some embodiments for the number of channels per pass to increase from the first pass to the second pass and so forth, as is the case for the embodiment of FIGS. 3 and 4. The reduced number of channels in the upstream passes can aid in achieving a uniform distribution of flow among the channels when the flow is all or mostly liquid and consequently has a relatively high density. As the flow moves downstream and the vapor quality increases, the mean density of the flow decreases and a greater number of channels can be used in order to accommodate the increased volumetric flow rate without compromising flow distribution.

In the illustrated embodiment, the collection manifold 25 consists of three approximately parallel slots 25*a*, 25*b* and 25*c* extending through the fluid flow plate 4. In different embodiments, the collection manifold can consist of more or fewer slots, so that the flow area in the collection manifold can be adjusted. Some advantages can be found, however, in having multiple slots to comprise the manifold rather than one larger slot. A smaller slot width will result in a smaller hydraulic diameter than a larger slot width, and this will reduce the negative impact on heat transfer performance caused by removal of the corrugations in the slot area. Additionally, a smaller slot width will provide greater structural support to resist deformation of the shells 5, 7 when the second fluid flow 3 is at a substantially higher pressure than the first fluid flow 2, as is frequently the case in evaporative systems. It should be understood by those having skill in the art that the proper slot width and number of slots may vary depending on the application.

In a manner similar to that described above, the fluid flows through the pass 16, then by way of the manifolds 26 and 27 through the pass 17, then by way of the manifolds 28 and 29 through the pass 18, then by way of the manifolds 30 and 31 through the pass 19, then by way of the manifolds 32 and 33 through the pass 20, then by way of the manifolds 34 and 35 through the pass 21, after which the fluid exits the heat exchanger 1 through outlet port 12.

The manifolds 24, 28 and 32 at the end 40 are separated from each other by protrusions 36 that extend from the wall of the recess in the plate 5 that houses the fluid flow plate 4. These protrusions extend approximately to the end 40 of the fluid flow plate 4 in order to provide a highly tortuous flow path for the fluid to flow directly from one of the manifolds 24, 28 and 32 to an adjacent one of the manifolds 24, 28 and 32 without passing through two of the flow passes in the plate 4. Similar protrusions 36 prevent or substantially inhibit bypass flow from the inlet port 11 to the manifold 24, and between the manifolds 22, 26, 30 and 34 located at the end 41.

In some embodiments, the bypass prevention may be improved by providing notches in the fluid flow plate 4 to receive portions of the protrusions 36 therein in order to provide an even more tortuous flow path. In some embodiments the protrusions 36 may be joined to one or more of the corrugations comprising the channels 13 of the fluid flow plate 4 to completely block such bypass flow. In some such embodiments, the joining can be accomplished by creating a brazed joint. In such embodiments, the protrusions 36 can block off one end of one or more of the channels 13 located between adjacent passes in the fluid flow plate 4 in order to direct substantially all of the fluid flow through the passes. In some embodiments, the flow blocking protrusions 36 may alternatively extend from the fluid flow plate 4 to engage the wall of the plate 5.

The flow manifolds 26, 28, 30, 32 and 34 also can be seen to include a flow area constriction region defined by features 37 that extend partially into the manifolds from the wall of the plate 5, the purpose of which will be described later.

Figure 5A:
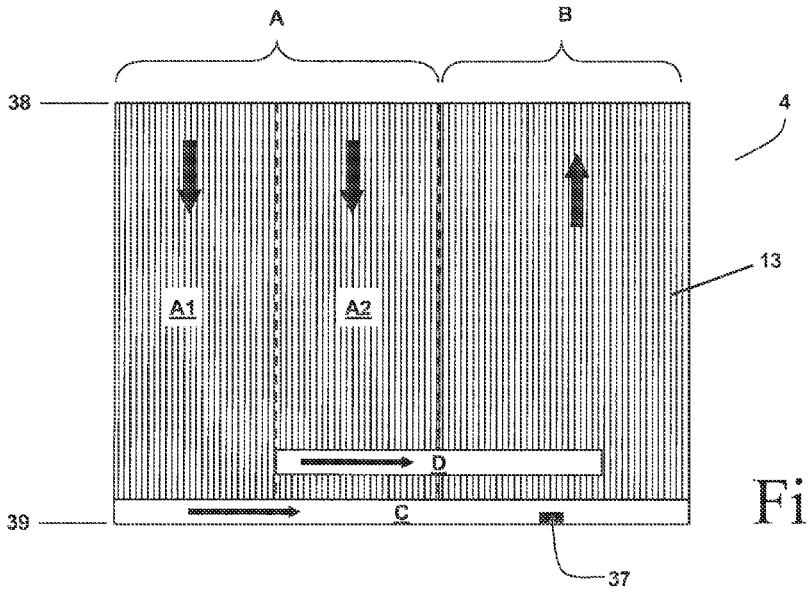
FIGS. 5*a-c* are diagrammatic illustrations of possible fluid flow paths through a heat exchanger according to embodiments of the present invention.
Figure 5B:
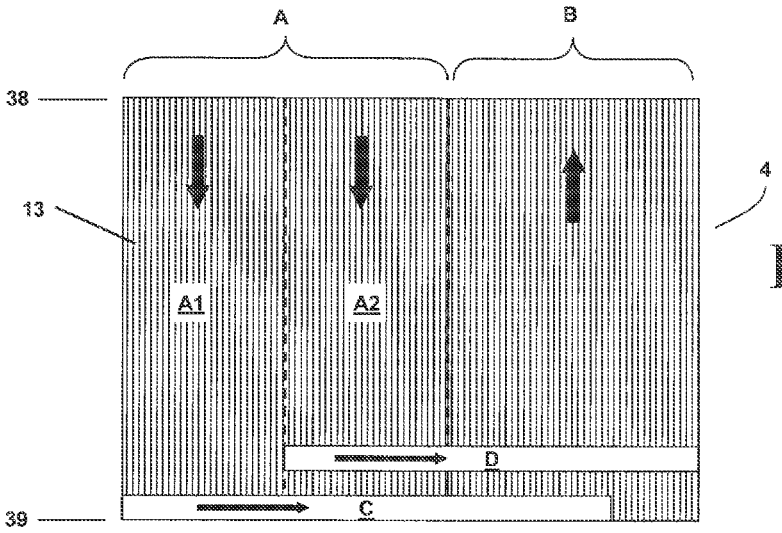
Figure 5C:
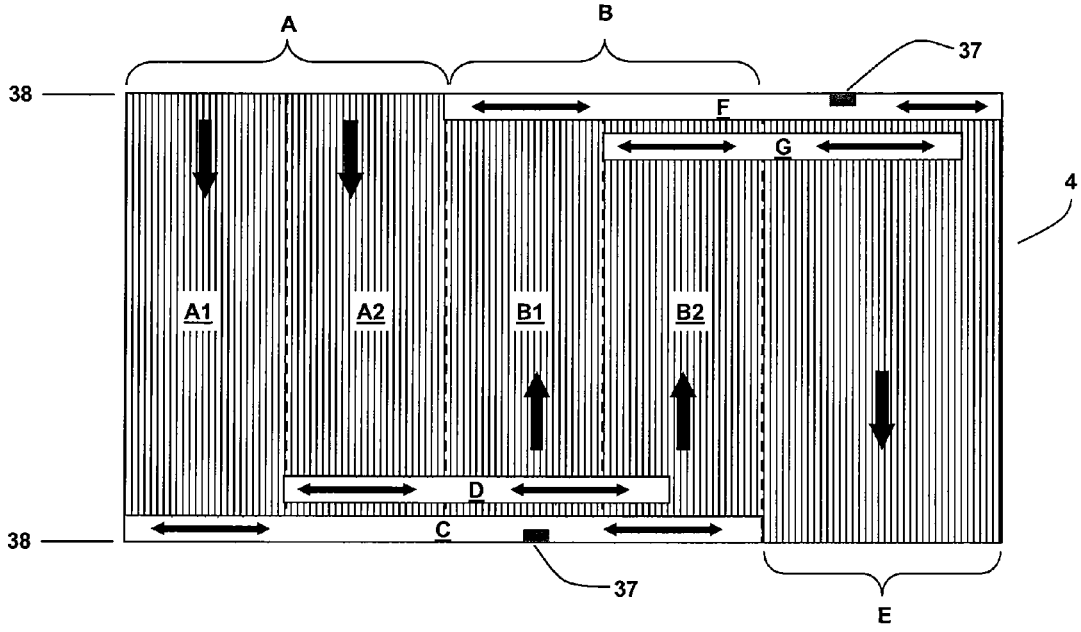

Turning now to FIGS. 5*a*-*c*, some of the aspects of the present invention will be described. FIG. 5*a* illustrates a portion of the fluid flow path for the second fluid flow 3 as it passes through a heat exchanger 1 according to some embodiments of the present invention. The arrows represent the overall flow direction of the fluid in the various depicted sections of the fluid flow path.

The portion of the fluid flow path shown in FIG. 5*a* includes a pass A and a pass B located adjacent to and immediately downstream from the pass A, each of the passes A, B comprising a plurality of parallel flow channels such as the channels 13 of the embodiment of FIG. 3. The passes A and B may be any two adjacent passes along the fluid flow path. For example, they could represent any adjacent pair of the passes 14-21 in the embodiment of FIGS. 3 and 4.

The passes A and B extend from an end 38 of the fluid flow plate 4 to an end 39 of the fluid flow plate 4. Additional (not shown) flow passes may be located upstream and/or downstream of the passes A and B. The ends 38 and 39 can correspond to the ends 40 and 41, respectively, in the embodiment of FIGS. 3 and 4 if the pass A corresponds to one of the even-numbered passes 14, 16, 18 or 20. Likewise, the ends 38 and 39 can correspond to the ends 41 and 40, respectively, in the embodiment of FIGS. 3 and 4 if the pass A corresponds to one of the odd-numbered passes 15, 17 or 19.

The passes A and B are fluidly connected to one another by way of manifolds C and D, where manifold C is located at the end 39 and manifold D is located between the ends 38 and 39. The pass A comprises a set of channels A1 that directly connect to the manifold C, and another set of channels A2 that directly connect to both manifolds C and D.

The channels comprising the pass B are each connected to at least one of the manifolds C and D. As shown in FIG. 5*a*, in some embodiments, some of the channels comprising the pass B are connected to the manifold C but are not connected to the manifold D, while the other of the channels comprising the pass B are connected to both manifolds C and D. In other embodiments, such as the one shown in FIG. 5*b*, some of the channels comprising the pass B are connected to the manifold D but are not connected to the manifold C. In still other embodiments, all of the channels comprising the pass B may be connected to both manifolds C and D.

When a heat exchanger including a flow plate 4 according to the embodiment of FIG. 5*a* is operated as an evaporative heat exchanger, with the evaporating fluid flowing as a two-phase fluid through pass A, the liquid and vapor phases of the portion of the fluid in the set of channels A2 will tend to separate from one another when the fluid encounters the manifold D. Due to its lower density, the vapor phase will experience a much greater pressure drop than the liquid phase will in passing from the manifold D back into the channel region between manifolds D and C. As a result, the vapor phase portion of the fluid traveling in the channels of section A2 will tend to flow in greater proportion through the manifold D. The liquid phase portion, in contrast, is more likely to continue straight through into the manifold C.

As a result of having the set of channels A1 only connect to the manifold C, the entirety of the fluid traveling in the set of channels A1 will be directed into manifold C. This can prevent the accumulation of liquid in manifold C, as any vapor present in the set of channels A1 will "push" the liquid through into the pass B. In the embodiment of FIG. 5*a*, in some embodiments, it is preferable to include a local constriction of the manifold C, such as by the presence of the partial flow blocking feature 37. Including such a local constriction can prevent the entirety of the flow in manifold C from flowing all the way to the end of that manifold and into only the last few channels of the pass B. When the fluid reaches the local constriction, a substantial portion of the fluid will be directed into the manifold D, from where it can then be distributed into the channels of pass B that are directly connected to manifold D.

In the alternative embodiment of FIG. 5*b*, the manifold C does not extend to all of the channels of pass B, and all of the fluid in the manifold C is directed into the manifold D, from where it can then be distributed to the channels of pass B.

In the embodiment of FIG. 5*c*, an additional flow pass E immediately adjacent to pass B is shown. The passes B and E are fluidly connected to one another by a manifold F located at the end 38 of the flow plate 4, and by a manifold G located between the ends 38 and 39. One set B1 of the channels of pass B are connected only to the manifold F, while a separate set B2 of the channels are connected to both manifolds F and G, so that the manifolds F and G can provide similar benefits as was described with reference to the manifolds C and D. It should be readily apparent that this pattern can be repeated as necessary in order to provide the desirable number of flow passes for a particular application.

Figure 6:
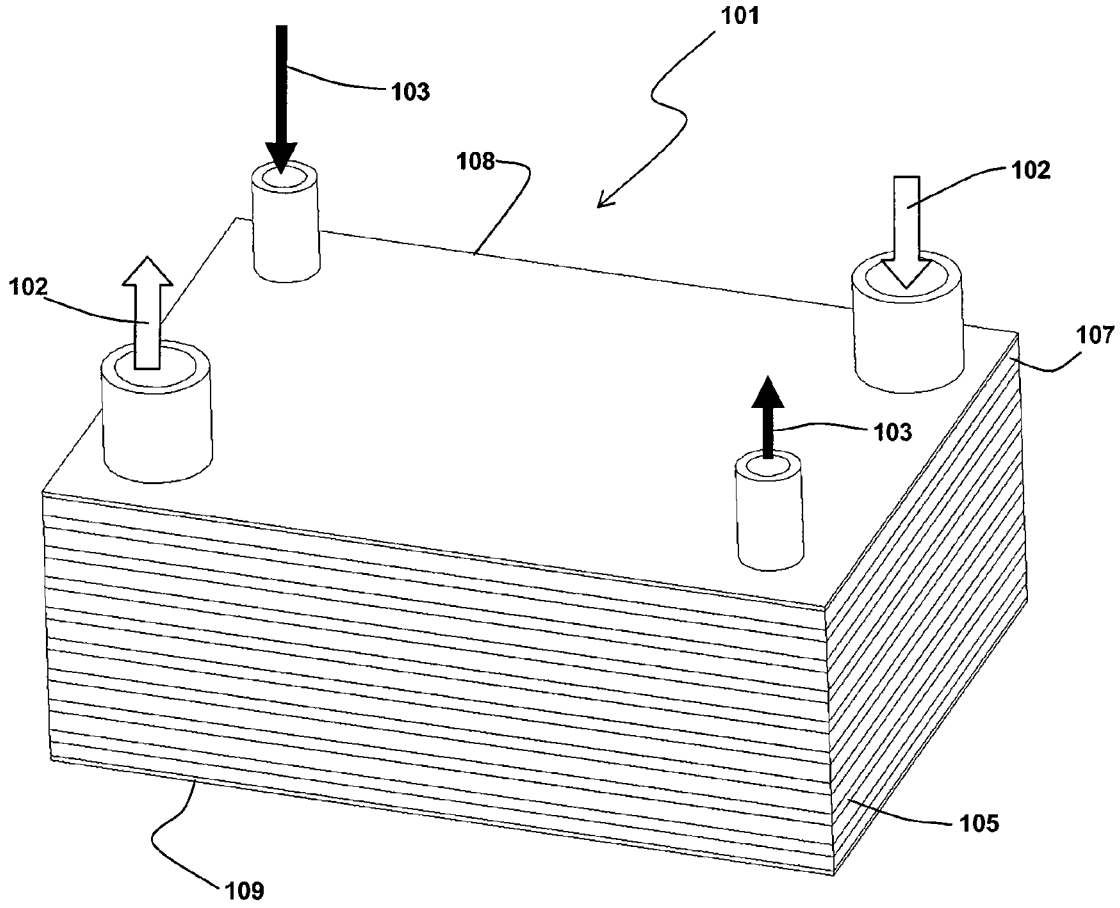
FIG. 6 is an isometric view of a heat exchanger according to another embodiment of the present invention.
Figure 7:
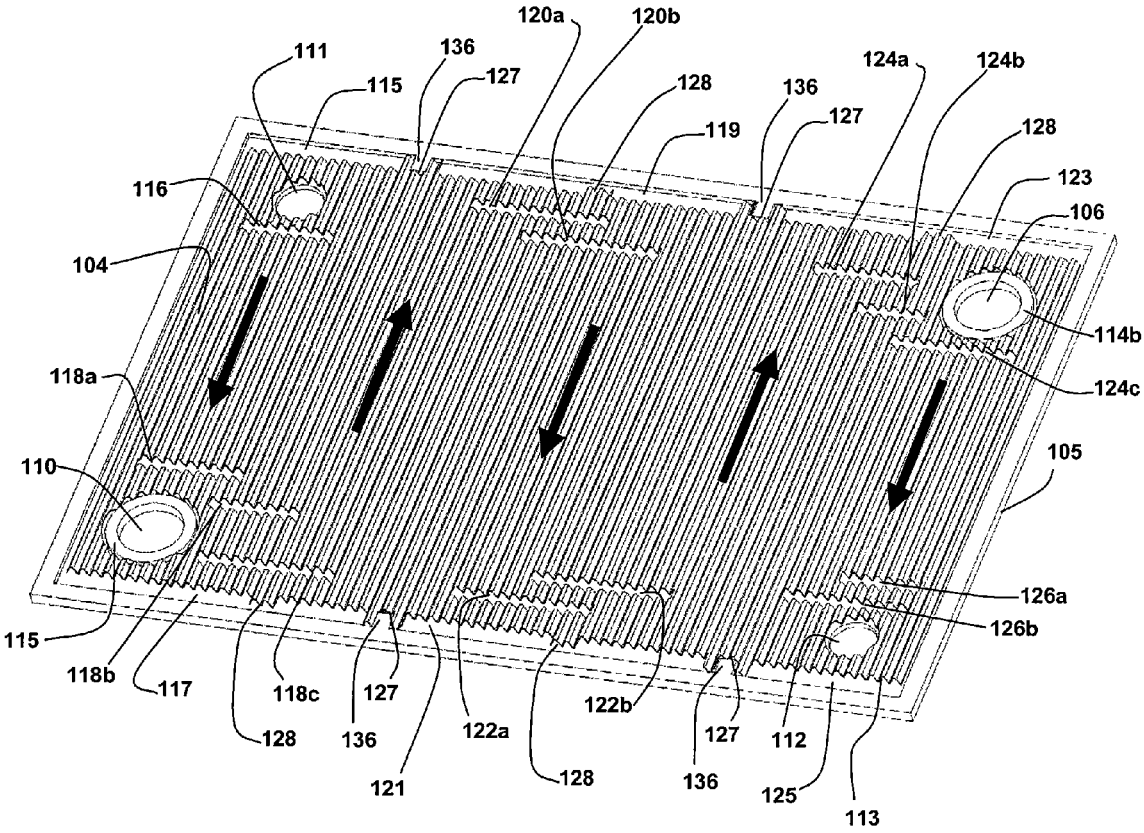
FIG. 7 is an isometric view of certain portions of the heat exchanger of FIG. 6.

FIG. 6 illustrates another embodiment of a heat exchanger 101 of the present invention. A hot fluid flow 102 and an evaporating fluid flow 103 are directed into and out of the heat exchanger 101 through ports in the top plate 108 of the heat exchanger 101. Such an embodiment can operate as a liquid chiller in a refrigeration or climate control system, wherein the hot fluid flow 102 is a liquid that is chilled by evaporation of a refrigerant flow 103. As seen in FIG. 7, in such an application, the fluid flow plate 104 can include openings 111, 112 corresponding to the port locations for the fluid flow 103. The flow 103 is distributed by way of the openings 111 to the plurality of layers 105 containing the flow plates 104. Within the fluid flow plate 104, the fluid flow 103 is directed though multiple passes of the parallel arranged flow channels 113, as indicated by the arrows in FIG. 7.

The flow 113 is distributed into the first pass by way of the manifolds 115 and 116. From the first pass, the flow 113 is distributed into the second pass by way of the manifolds 117 and 118, which serve the purpose of the manifolds C and D of FIGS. 5*a-c*. Specifically, it can be seen that some of the channels 113 belonging to the first pass are connected to the manifold 117 but not to the manifold 118, whereas others of the channels are connected to both manifolds 117 and 118.

Some of the flow channels 113 may be blocked by a ring 115 surrounding a port 110 through which the flow 102 is collected from the plurality of flow layers 107 interleaved with the flow layers 105. A portion 118*a* of the manifold 118 is located so as to intersect those channels and allow for the fluid passing through those channels to bypass around the ring 115.

The flow 103 is directed into the second pass from the manifolds 117 and 118, and is directed from the second pass into the third pass through the manifolds 119 and 120. The fluid is directed from the third pass to the fourth pass through the manifolds 121 and 122, and from the fourth pass to the fifth pass through the manifolds 123 and 124. The manifolds 125 and 126 redirect the fluid from the fifth pass into the port 112, through which the fluid 103 is removed from the heat exchanger 101.

Similar to the first pass, some of the channels in the fifth flow pass are blocked by a ring 114 surrounding the inlet distribution port 106 for the fluid 102. A portion 124*c* of the manifold 124 is located such that a portion of the fluid 103 can be directed into those channels despite the flow blockage due to the ring 114.

The manifolds 117, 119, 121 and 123 have local constrictions caused by protrusions or extensions 128 protruding from the fluid flow plate 104 into the manifold areas. These extensions 128 serve a similar function as the previously described protrusions 37.

The manifolds 117, 121 and 125 are separated from one another by protrusions 136 extending from the wall of the plate 105, said protrusions being received into notches 127 in the fluid flow plate 104. The manifolds 115, 119 and 123 are similarly separated from one another.

Various alternatives to the certain features and elements of the present invention are described with reference to specific embodiments of the present invention. With the exception of features, elements, and manners of operation that are mutually exclusive of or are inconsistent with each embodiment described above, it should be noted that the alternative features, elements, and manners of operation described with reference to one particular embodiment are applicable to the other embodiments.

The embodiments described above and illustrated in the figures are presented by way of example only and are not intended as a limitation upon the concepts and principles of the present invention. As such, it will be appreciated by one having ordinary skill in the art that various changes in the elements and their configuration and arrangement are possible without departing from the spirit and scope of the present invention.

What is claimed is:

1. An evaporative heat exchanger operable to at least partially vaporize fluid, the heat exchanger comprising:

a plurality of parallel flow passages extending through the heat exchanger, together the plurality of flow passages defining a first fluid flow path; and a plurality of substantially parallel stacked plates interleaved with the parallel flow passages, each plate having a first end and a second end spaced apart from the first end and at least partially defining:

a first set of flow channels extending from the first end to the second end;

a second set of flow channels extending from the first end to the second end parallel to the first set of flow channels, the first and second sets of flow channels together comprising a first flow pass of a second fluid flow path;

a third set of flow channels extending from the first end to the second end and comprising a second flow pass of the second fluid flow path substantially parallel to the first flow pass of the second fluid flow path;

a first collection manifold adjacent to the second end, positioned beyond the first set of flow channels and connecting the first and second passes; and a second collection manifold between the first end and the second end, the second collection manifold intersecting the second set of flow channels and at least some of the third set of flow channels.

2. The heat exchanger of claim 1, wherein the first and second collection manifolds are arranged approximately perpendicular to the first set of flow channels.

3. The heat exchanger of claim 1, wherein at least one of the first and second collection manifolds is generally arcuately shaped.

4. The heat exchanger of claim 1, wherein at least one of the flow channels comprising the third set of flow channels is directly connected to the first collection manifold and is not intersected by the second collection manifold.

5. The heat exchanger of claim 1, wherein the plurality of separate parallel flow passages are arranged to direct the first fluid through the heat exchanger in a direction approximately perpendicular to the first and second flow passes for the second fluid.

6. The heat exchanger of claim 1, wherein the plurality of separate parallel flow passages are arranged to direct the first fluid in two or more sequential passes through the heat exchanger.

7. The heat exchanger of claim 1, wherein the second collection manifold comprises at least one slot extending through the plate.

8. The heat exchanger of claim 7, wherein:

the first, second, and third sets of flow channels have a common channel width;

the at least one slot has a common manifold slot width; and the common manifold slot width is substantially the same as the common channel width.

9. The heat exchanger of claim 1, wherein each plate further comprises:

a fourth set of flow channels extending from the first end to the second end parallel to the third set of flow channels, the fourth set of flow channels additionally comprising the second flow pass for the second fluid;

a fifth set of flow channels extending from the first end to the second end comprising a third flow pass for the second fluid parallel to the first and second flow passes for the second fluid;

a third collection manifold adjacent to the first end and connecting the second and third passes; and a fourth collection manifold between the first end and the second end, the fourth collection manifold intersecting the fourth set of flow channels and at least some of the fifth set of flow channels, where the third set of flow channels is not intersected by the fourth collection manifold.

10. The heat exchanger of claim 1, further comprising a plurality of stamped plates to at least partially define the plurality of separate parallel flow passages, each of the stamped plates including a recessed area to receive one of the plates.

11. The heat exchanger of claim 1, wherein the first collection manifold has a non-constant width.

12. The heat exchanger of claim 11, wherein the non-constant width is at least partially defined by a projection of the plate.

13. The heat exchanger of claim 11, wherein the first collection manifold is at least partially defined by a wall adjacent to the second end of a plate, and wherein the non-constant width is at least partially provided by a projection extending from the wall into the first collection manifold.

14. The heat exchanger of claim 1, further comprising an inlet port fluidly connected to the first flow pass to deliver fluid thereto, and an outlet port fluidly connected to a flow pass downstream of the first flow pass to receive the fluid therefrom.

15. The heat exchanger of claim 14, wherein at least one of the inlet port and the outlet port is located between the first end and the second end of one of the plurality of plates.

16. The heat exchanger of claim 1, wherein each plate further comprises a fourth set of flow channels positioned between the first and second flow passes, the fourth set of flow channels extending from the second end to a location between the first end and the second end, the fourth set of flow channels being substantially blocked with respect to fluid flow at the location.

17. The heat exchanger of claim 1, wherein the number of flow channels comprising the second flow pass is greater than the number of flow channels comprising the first flow pass.

18. The heat exchanger of claim 1, wherein each of the plates is a corrugated sheet, and wherein corrugations of each of the plates define the first, second, and third sets of flow channels.

19. The heat exchanger of claim 18, wherein the second collection manifold includes at least one opening extending through the corrugated sheet.

20. The heat exchanger of claim 1, wherein the first collection manifold transfers at least a portion of a fluid traveling along the first pass to the second pass, and wherein the second collection manifold receives at least a portion of the fluid from the first pass and transfers the portion to the second pass.

* * * * *